United States Patent [19]

Armbruster

[11] Patent Number: 4,954,049

[45] Date of Patent: Sep. 4, 1990

[54] AIR CIRCULATION DEVICE

[76] Inventor: Joseph M. Armbruster, 2700 NE. 47th St., Lighthouse Point, Fla. 33064

[21] Appl. No.: 372,175

[22] Filed: Jun. 27, 1989

Related U.S. Application Data

[63] Continuation of Ser. No. 73,085, Jul. 14, 1987, abandoned.

[51] Int. Cl.[5] ..... F04B 39/12

[52] U.S. Cl. ..... 417/234; 417/423.9; 417/423.14; 415/121.2; 415/206

[58] Field of Search ..... 417/234, 313, 423 K, 417/423 L, 423 T; 415/121 Q, 121 Q, 121 R, 219 C, 206, 126, 127; 416/178

[56] References Cited

U.S. PATENT DOCUMENTS

| | | | |
|---|---|---|---|
| 2,631,775 | 3/1953 | Gordon | 417/423 L X |
| 3,106,334 | 10/1963 | Fogleman et al. | 415/121 X |
| 3,120,340 | 2/1964 | Strumpell | 415/127 X |
| 3,960,527 | 6/1976 | Goettl | 417/423 T X |
| 4,483,664 | 11/1984 | Armbruster | 417/234 |
| 4,694,528 | 9/1987 | Comer et al. | 417/234 X |

FOREIGN PATENT DOCUMENTS

| | | | |
|---|---|---|---|
| 1234767 | 10/1960 | France | 417/423.14 |
| 1405944 | 9/1975 | United Kingdom | 415/206 |

*Primary Examiner*—Leonard E. Smith

*Assistant Examiner*—Eugene L. Szczecina, Jr.

*Attorney, Agent, or Firm*—Fleit, Jacobson, Cohn, Price, Holman & Stern

[57] ABSTRACT

An air circulation device including a blower having a hollow housing with a rotatable squirrel cage blower incorporated therein with discharge louvers being adjustable for controlling the direction of air flow discharged from the air circulation device. The air circulation device is supported on a stand of hollow construction having air inlet openings elevated above the lower end thereof together with a filter structure associated with the air inlet openings to remove particulate material and pollutants from the air taken into the air circulation device with hollow air transfer members extending from the hollow stand to the interior of the squirrel cage blower through doughnut shaped seal devices of lightweight compressible foam material. The air circulation device is provided with a control switch arrangement and an outlet receptacle together with other optional features including flexible hoses that can be connected to the inlets or the outlet and the option of providing support wheels for the stand to enable the assembly to be moved to a desired location. Also the air circulation device includes mounting plates having angulated portions enabling the air circulation device to be utilized independently of the stand and oriented in various angular positions as determined by the number of angled portions on the mounting plates rigidly affixed to the housing.

8 Claims, 2 Drawing Sheets

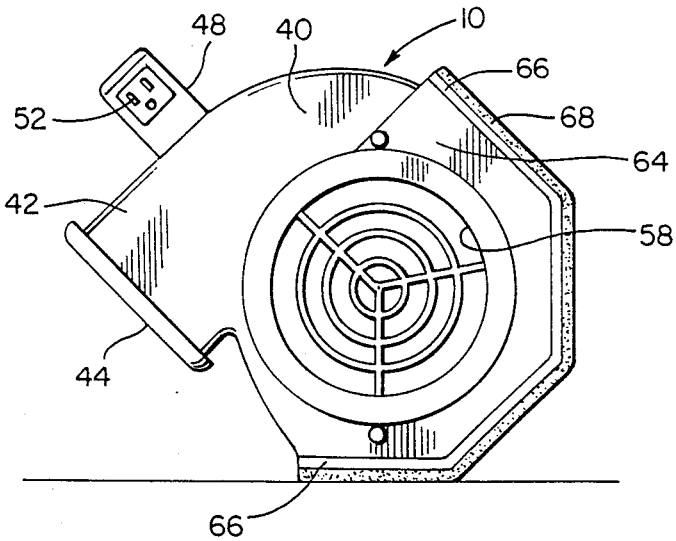
FIG. 4
FIG. 5
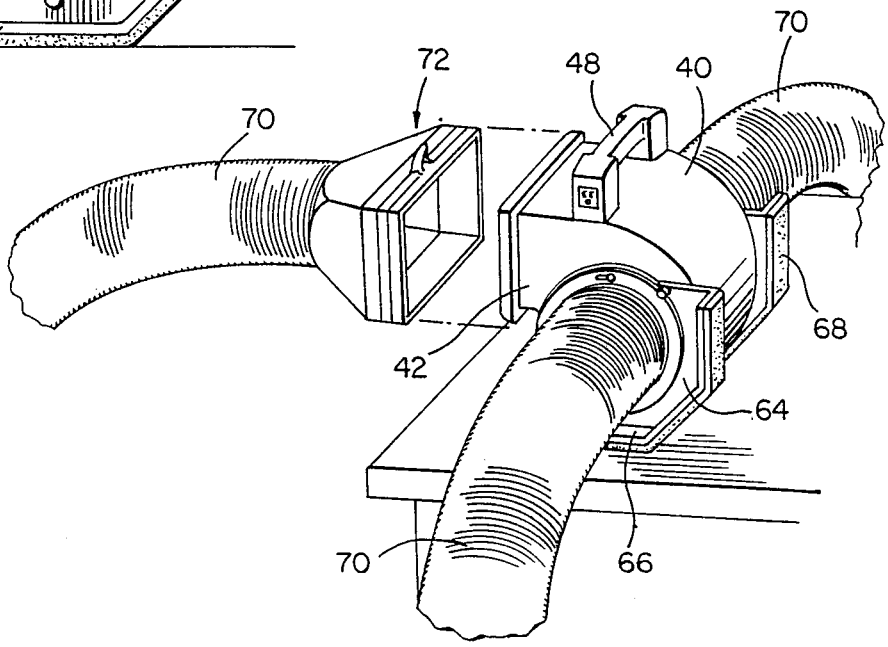
FIG. 6
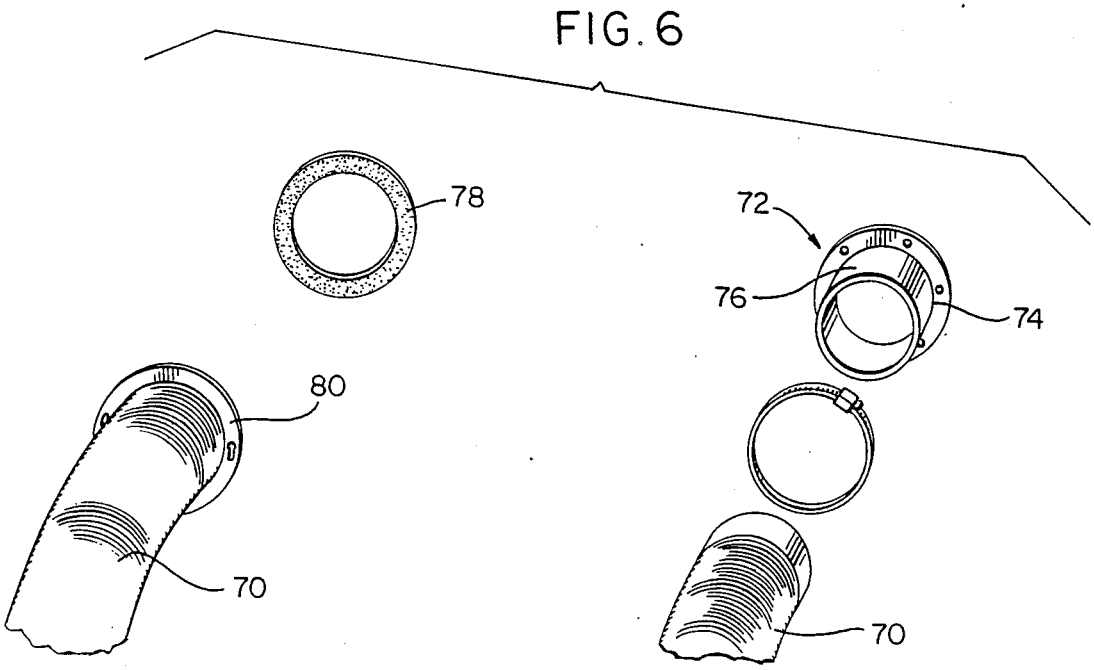

AIR CIRCULATION DEVICE

This application is a continuation of application Ser. No. 07/073,083, filed July 14, 1987 now abandoned.

BACKGROUND OF THE INVENTION

1. Field of the Invention

The present invention generally relates to an air circulation device including a blower having a hollow housing with a rotatable squirrel cage blower incorporated therein with discharge louvers being adjustable for controlling the direction of air flow discharged from the air circulation device. The air circulation device is supported on a stand of hollow construction having air inlet openings elevated above the lower end thereof together with a filter structure associated with the air inlet openings to remove particulate material and pollutants from the air taken into the air circulation device with hollow air transfer members extending from the hollow stand to the interior of the squirrel cage blower through doughnut shaped seal devices of lightweight compressible foam material. The air circulation device is provided with a control switch arrangement and an outlet receptacle together with other optional features including flexible hoses that can be connected to the inlets or the outlet. Also the air circulation device includes mounting plates having angulated portions enabling the air circulation device to be utilized independently of the stand and oriented in various angular positions as determined by the number of angled portions on the mounting plates rigidly affixed to the housing.

INFORMATION DISCLOSURE STATEMENT

Various types of air circulation devices are well-known including those disclosed in prior U.S. Pat. Nos. D169,007, D181,083, D184,316, D269,116, D275,698, 1,224,306, 2,164,608, 2,868,558, 4,424,006 and 4,483,664.

SUMMARY OF THE INVENTION

An object of the present invention is to provide an air circulation device in which facility is provided to remove particulate material from air being circulated and also remove various air pollutants in order to provide a supply of filtered and clean air.

Another object of the invention is to provide an air circulation device with a supporting stand providing air inlet openings spaced above the lower end thereof with an air circulation device being mounted on top of the supporting stand with the air circulation device including a housing with a squirrel cage blower incorporated therein in which the housing includes oppositely disposed inlets connected to the hollow interior of the upper end of the stand to enable air inlet into the blower housing with the blower housing including an outlet provided with adjustable louvers to enable directional control of the air being discharged from the blower.

A further object of the present invention is to provide an air circulation device in which the air filter includes multiple stage filters including a first stage filter for removing particulate material and a second stage filter of activated charcoal or the like for removing various pollutants from the air.

Still another object of the invention is to provide an air circulation device in which the blower housing includes a handle, switch structure, outlet receptacle, and mounting plates including a plurality of angled portions to enable the housing to be supported on a supporting surface, wall surface or the like at different angular positions for supporting the housing in optimum relation to a desired work site for providing air circulation to that work site.

Still another important object of the present invention is to provide an air circulation device including adapter units enabling flexible inlet hoses to be connected to the inlets and a flexible outlet hose to be connected to the outlet to further facilitate circulation of air from and to a desired site.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 4 is a side elevational view of the air circulation device.

FIG. 5 is a perspective view of the air circulation device with hoses attached thereto.

FIG. 6 is a detailed view of the connecting fittings for the hoses.

DESCRIPTION OF THE PREFERRED EMBODIMENT

Figure 1:
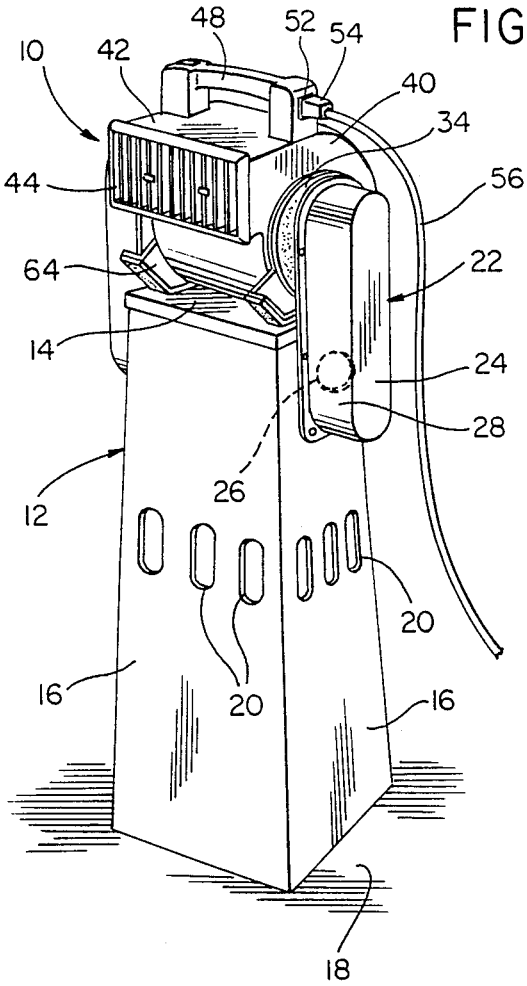
FIG. 1 is a perspective view of the air circulation device of the present invention illustrating the general association of the components.
Figure 2:
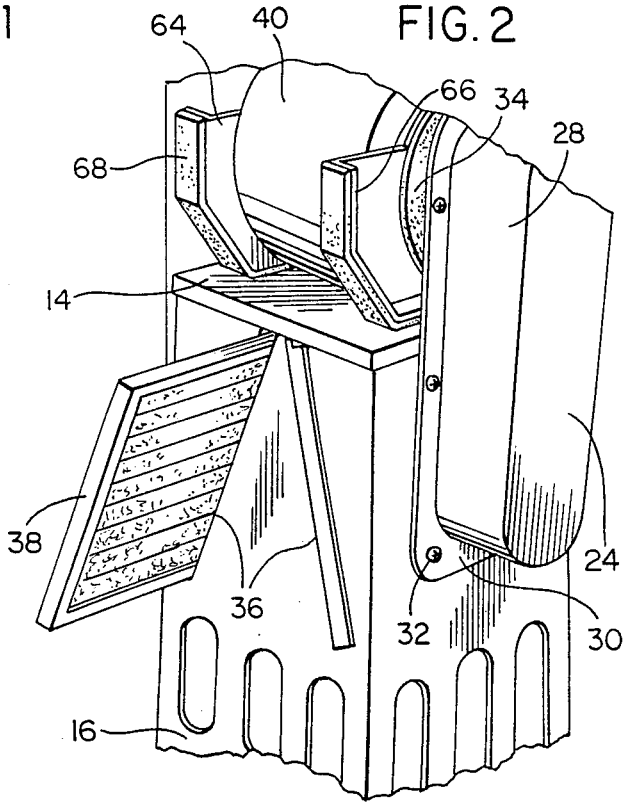
FIG. 2 is a fragmental rear perspective view of the present invention illustrating the structure of the stand and inserted filter assemblies.

Referring now specifically to the drawings, the air circulation device of the present invention is generally designated by reference numeral 10 and, in FIGS. 1 and 2, is supported by a hollow stand 12 having an upper platform or tray 14 that is disposed horizontally and removably supports the air circulation device 10 thereon.

The stand 12 includes four walls 16 that are generally vertically disposed but are inclined and taper upwardly slightly for connection with the supporting platform or tray 14. The bottom end of the stand 12 may be closed with a bottom wall or it may be open with the bottom edge of the walls 16 resting against a supporting surface 18. Spaced upwardly from the lower end of the walls 16, each wall 16 is provided with a plurality of enlarged air inlets 20 which are generally oval shaped in configuration with the inlets 20 being spaced above the supporting surface so that air can enter the hollow interior of the stand 12.

One pair of opposed walls 16 has a hollow air transition device 22 connected thereto which forms a vertical passageway to the air circulation device 10 at opposite sides thereof. The air transition device includes an outer wall 24 which is elongated and integral with a peripheral wall 28 having an outwardly extending flange 30 at the inner edge thereof. The portion of the flange overlying the upper end of the opposed walls 16 is secured to the walls 16 by fasteners 32 and is communicated with an enlarged opening 26 in the walls 16 in alignment with the interior of the air transition device 22. The upper end portion of the air transition device 22 includes a doughnut shaped seal 34 which peripherally seals the air transition device to the air circulation device 10 for communicating the air within the stand 12 with the air circulation device. Those areas of the inner portion of the air transition device below the seal and above the opening 26 in the walls 16 of the stand 12 are closed by an inner wall so that the air circulation device will cause circulation of air in through the inlets 20 and out into the air transition devices and into the air circulation device.

One of the walls 16 other than that which has the air transition device 22 connected thereto, such as the rear wall, is provided with a pair of vertically and upwardly inclined slots 36 which slidably receives a filter assembly 38 so that the filter assemblies form an inverted V-shaped filter above the air inlets 20 and inwardly and below the portion of the air transition device 22 that is communicated with the interior of the stand 12. The filters 38 may be disposable or multi-stage with a foam filter being provided to remove particulate material and an activated charcoal filter provided to remove pollutants from the air circulated inwardly through the inlets 20 and up through the air transition devices 22 into the air circulation device.

Figure 3:
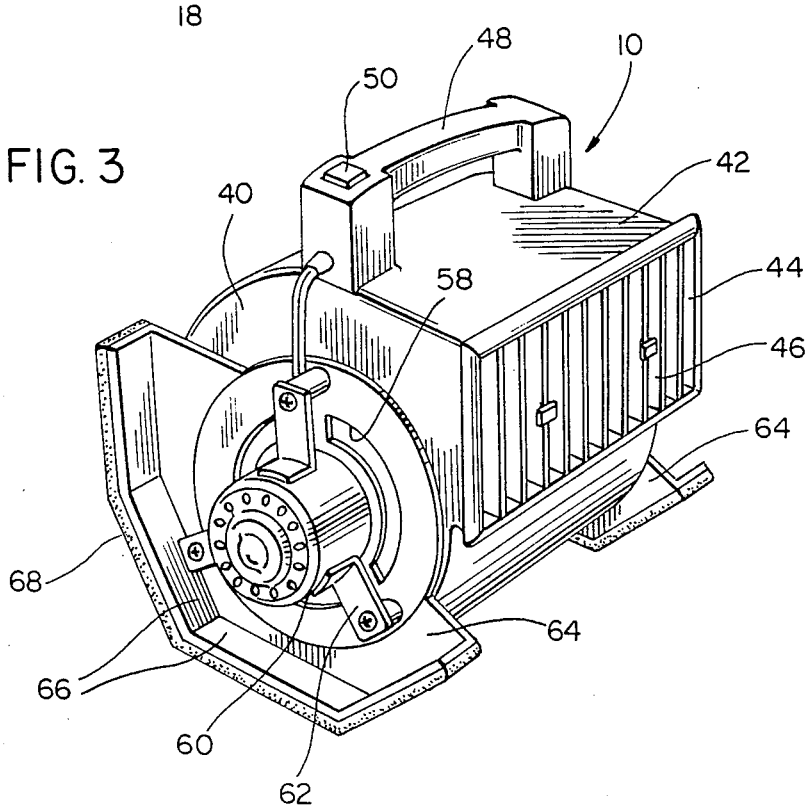
FIG. 3 is a perspective view of the air circulation device separated from the supporting stand.

As illustrated in FIG. 3, the air circulation device 10 includes a housing 40 of plastic, metal or the like with the housing generally being cylindrical and provided with a tangential discharge 42 including a discharge outlet or opening 44 having a plurality of vertical louvers 46 therein which are laterally pivotal to direct the air laterally in relation to the housing. A handle structure 48 is formed integrally with the housing and one end of the handle structure includes a control switch 50 for the air circulation device and the other end of the handle includes a female receptacle 52 for receiving a male plug 54 connected to an electrical cord 56 extending to any electrically powered accessory. Each end wall of the housing 40 is provided with an air inlet 58 which is screened with one of the air inlets including a motor 60 supported therefrom by suitable bracket structures 62 with the motor being partially received within the interior of a rotatable squirrel cage fan impeller so that the air circulation device will provide maximum air circulation capabilities.

The housing 40 also includes mounting plates 64 having four angular edge flanges 66 integral therewith with the outer surface of each angled edge flange 66 including a layer of cushioning material 68 thereon to enable the air circulation device to be supported from a supporting surface with any one of the angled flanges 66 engaging the supporting surface in order to orient the discharge outlet 44 in a desired angular direction, that is, oriented for horizontal discharge or downwardly directed discharge or upwardly directed discharge at different angles.

With this arrangement, the air circulation device may be mounted on the stand 12 and retained in place by the air seals 34 with the angled flanges 66 enabling the discharge outlet to be selectively oriented at different vertical positions about a horizontal axis with the louvers 46 being adjustable about vertical axes thereby controlling discharge of air laterally of the air circulation device 10.

The air circulation device may be separated from the stand and used independently thereof by supporting it on a horizontal support surface with the angled flanges 66 enabling directional control of the outlet 44. An inlet hose 70 may be connected to either or both of the inlets on the housing and optionally to the outlet 44. The hoses are flexible corrugated plastic hoses having a diameter generally equal to the inlet opening in the housing with the hose attached to the outlet being formed with a rectangular end portion conforming generally with the shape and configuration of the outlet 44. As illustrated, the hoses 70 may be attached by an adapter 72 having a flange 74 mounted on the housing 40 by suitable fasteners or the like with the flange 74 including a tubular extension 76 telescopically receiving the end of the hose 70 with a worm-type peripheral clamp being provided to secure the hose 70 to the adapter tube or sleeve 76. Various types of connections may be made between the hoses and housing including an annular ring of "Velcro" 78 around the inlet and a corresponding ring of "Velcro" 80 on the hose 70. Other arrangements may be provided for securing the hoses to the inlets and/or outlet such as interlocking keyhole fasteners, magnetic retainers and the like. Also, while the air circulation device 10 illustrated in the drawings includes a rigid housing mounted on the platform or tray 14 which may have an upstanding peripheral edge, the devices disclosed in my prior U.S. Pat. Nos. D269,116, D275,698, 4,424,006 and 4,483,664 having a housing which is adjustably supported on a base could also be supported on the platform or tray 14 with the air transition devices 22 being connected thereto. Alternatively, the air transition devices may be short sections of flexible hoses connected to the stand walls in alignment with an opening therein and inlet openings in the end walls of the housing 40.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is as follows:

1. An air circulation device comprising a hollow housing having a squirrel cage blower rotatably mounted therein and driven by an internally mounted motor with the housing including oppositely disposed air inlets for the squirrel cage blower, an air discharge outlet incorporated into said housing for discharge of air, said discharge outlet including adjustable louvers to provide directional control for air being discharged from the blower, and a vertically disposed supporting stand for the blower housing, said stand being hollow and including air inlet openings adjacent the lower end thereof but spaced upwardly from the lower end thereof, filter means in said stand above the air inlet openings for filtering air passing inwardly through the inlet openings and upwardly in the stand, air passage means extending from the upper end of the stand to the inlets in the blower housing, said air passage means including externally mounted tubular members connected to the air inlets through doughnut shaped, compressible, resilient foam seals thereby providing air circulation of filtered air, said filter means including a pair of upwardly inclined filter members inserted through slot-like openings in the stand above the air inlet openings, said blower housing including a handle and mounting plates engaged with the upper end of the stand for detachable connection thereto for enabling the blower and housing to be separated from the stand and used independently thereof.

2. The structure as defined in claim 1 wherein said mounting plates have angulated portions to engage a supporting surface for orienting the discharge outlet in the housing at various angular positions for directing air from the outlet to a desired location.

3. The structure as defined in claim 2 together with adapter means at both air inlets and air discharge outlet for connection with flexible hoses to enable air to be circulated from and to a remote site.

4. An air circulation device comprising a vertically elongated hollow stand having a closed upper end and a lower end, an air blower mounted on the upper end of the stand and having an inlet communicated with the hollow interior of the upper end portion of the stand, said air blower including a discharge outlet, said stand including a plurality of air inlets spaced upwardly from the lower end to admit air into the interior of the stand, filter means mounted in said stand above the air inlets to filter air passing upwardly in the stand into the air blower for cleaning and circulating cleaned air, said air blower including a housing with a squirrel cage blower mounted therein and provided with oppositely disposed air inlets and a centrally disposed air outlet for circulation of a large volume of air with reduced noise level, said blower being communicated with the stand by a pair of externally mounted tubular members extending upwardly from opposite sides of the stand and connected with the air inlets through a doughnut shaped seal structure for assuring passage of air into the blower, said discharge outlet including adjustable louvers, said blower including mounting plates detachably engaged with the support stand to enable the blower to be detached therefrom and used independently of the stand, said plates including angled portions to engage a supporting surface for orienting the air discharge outlet at various angular positions for directing it toward a desired site.

5. An air circulation device comprising a vertically elongated hollow stand having an upper and lower end, an air blower mounted on the upper end of the stand, said air blower including a housing with blower means mounted therein, said housing having an inlet means communicated with the hollow interior of the upper end portion of the stand, said air blower housing including a discharge outlet, said stand including air inlet means spaced upwardly from the lower end to admit air into the interior of the stand, filter means mounted in said stand above the air inlet means to filter air passing upwardly in the stand into the air blower housing for cleaning and circulating cleaned air, said blower housing including mounting plates detachably engaged with the upper end of the stand to enable the air blower to be detached therefrom and used independently of the stand, said plates including angled portions to engage a supporting surface for orienting the air discharge outlet at various angular positions for directing it toward a desired site, said filter means including a filter member, said stand including a slot-like opening above the air inlet means in the stand to enable the filter member to be removably inserted into the stand above the air inlet means in the stand, said blower housing air inlet means including a pair of air inlets communicated with the interior of the stand by a pair of externally mounted tubular members extending upwardly from opposite sides of the stand and connected with the air inlets through a doughnut shaped seal structure for assuring passage of air into the blower housing, said filter means including a second filter member, said filter members being inclined to form a inverted V-shaped assembly.

6. A portable air circulation device comprising an air blower including a housing, said housing including a generally horizontally disposed cylindrical member provided with a tangential peripheral air outlet and end walls, at least one of the end walls including an air inlet, blower means mounted in said housing in communication with said air inlet and air outlet, support means on said housing for resting on a horizontal supporting surface, and handle means on said housing in spaced relation to said air inlet and air outlet for lifting, carrying and positioning said housing on the supporting surface, said support means comprising end mounting plates extending rigidly and laterally from the end walls of the housing only in areas circumferentially spaced from the air outlet and handle means, each of said end plates including a plurality of angulated edge portions oriented in endwise connected relation with adjacent edge portions being oriented in angular relation, said edge portions of the end plates supporting the housing from the supporting surface in different angular positions in relation to the supporting surface and spacing the air outlet above the supporting surface in all positions of the housing on the supporting surface.

7. The structure as defined in claim 6 wherein adjacent edge portions of the end plates are in 45° angular relation to each other, each of said angulated edge portions including edge flanges perpendicular to said end plates to stabilize the housing on the supporting surface, each edge flange including cushioning material on the outer surface thereof for engaging the supporting surface, said blower means including an electric drive motor mounted on said one end wall, said handle means including switch means thereon to control operation of the drive motor.

8. The structure as defined in claim 7 together with a supporting stand having the horizontal supporting surface on the upper end thereof, said stand being hollow, provided with air inlets and filter means in the air flow path, and means communicating the hollow stand with said air inlet in the housing.

* * * * *